US007765932B2

(12) United States Patent
Allman

(10) Patent No.: US 7,765,932 B2
(45) Date of Patent: Aug. 3, 2010

(54) SHOCK TUBE INITIATOR

(75) Inventor: Scott Allman, Peakhurst (AU)

(73) Assignee: Method of Entry Technologies Pty Ltd, Peakhurst, NSW (AU)

( * ) Notice: Subject to any disclaimer, the term of this patent is extended or adjusted under 35 U.S.C. 154(b) by 715 days.

(21) Appl. No.: 11/798,791

(22) Filed: May 17, 2007

(65) Prior Publication Data

US 2007/0266881 A1 Nov. 22, 2007

(51) Int. Cl.
*C06C 5/06* (2006.01)

(52) U.S. Cl. ..... 102/275.11; 102/275.6

(58) Field of Classification Search ..... 102/275.6, 102/275.11

See application file for complete search history.

(56) References Cited

U.S. PATENT DOCUMENTS

| | | | | |
|---|---|---|---|---|
| 6,581,519 | B1 * | 6/2003 | Adams | 102/275.11 |
| 7,451,700 | B1 * | 11/2008 | Land | 102/218 |
| 7,665,401 | B2 * | 2/2010 | Ballantine et al. | 102/275.11 |
| 2008/0276818 | A1 * | 11/2008 | Ballantine et al. | 102/202.1 |
| 2008/0282922 | A1 * | 11/2008 | Land | 102/218 |

* cited by examiner

*Primary Examiner*—Troy Chambers
(74) *Attorney, Agent, or Firm*—Molins & Co.

(57) ABSTRACT

Described in this specification is a shock tube initiator that is suitable for one, two, or more shock tubes. The initiator has a number of safety features to avoid inadvertent firing of the shocking primer. Features include a rotary safety and a firing plunger that selectively interfere with the firing pin. There may further be a safety pin for fixating the rotary safety onto the housing of the initiator, so users must deliberately remove the safety pin before the rotary safety can be disengaged.

20 Claims, 3 Drawing Sheets

SHOCK TUBE INITIATOR

FIELD OF THE INVENTION

The invention pertains to shock tube initiators and more particularly to a shock tube initiator having a protective housing and a capacity to initiate two shock tubes at the same time.

BACKGROUND OF THE INVENTION

The invention pertains to shock tube initiators that work in conjunction with a shock primer for purpose of generating an explosive shock wave through the shock tube to a detonator. Dual and single shock tube initiators have been used for many years to initiate non-electric shock tube. Most such devices consist of a main body, a firing pin and associated springs and actuators and many devices of this kind have external mechanisms that are capable of fowling on clothing or on equipment during the firing sequence.

The present invention proposed a device with at least three safety mechanism, having most of its moving parts contained with a housing and adapted to initiate one, preferably two, or more shock tubes simultaneously.

OBJECTS AND SUMMARY OF THE INVENTION

It is an object of the invention to provide a shock tube initiator having a housing within which is located one or more firing pins and the firing pin springs.

It is another object of the invention to provide a shock tube initiator having at lease three user defeatable safety mechanisms.

In preferred embodiments, the device comprises an optional shock tube block that carries cable glands for directly coupling a shock tube to the device.

Accordingly, there is provided a shock tube initiator comprising a housing having a front portion, a rear, portion, and an internal compartment between the front and rear portions. The initiator further comprises one or more grooves located within the internal compartment, the grooves leading into guide bores that pass through the front portion. Two firing pins are adapted to reciprocate in the grooves, each pin having a forward end that carries a front nose and a rearward end that carries a rear stub. The rear stub is adapted to locate and retain a compression spring for driving the firing pins forward. There is a first safety mechanism for preventing an inadvertent retraction of the pins against the compression spring. A cocking block is located to the front of, and adapted to retract, the firing pins. The cocking block receives, and is retractable by, a cocking handle that passes through the block and a rear end of the housing. A reciprocating firing plunger has a depressed position in which the plunger interferes with the firing pin, or a retracted position in which the plunger does not interfere with the firing pin.

An optional shock tube block is provided.

BRIEF DESCRIPTION OF THE DRAWING FIGURES

BEST MODE AND OTHER EMBODIMENTS OF THE INVENTION

Figure 1:
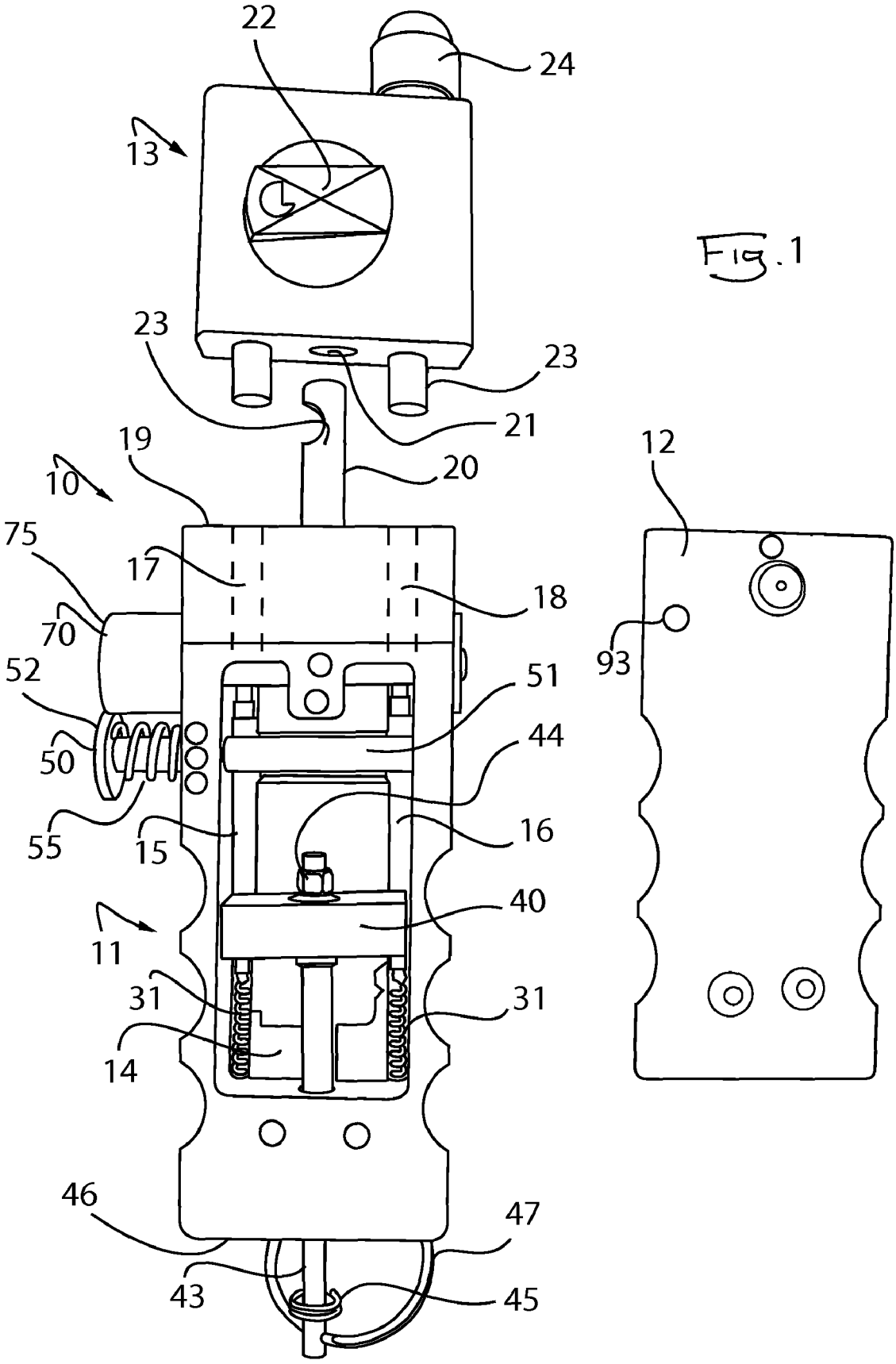
FIG. 1 is a perspective view of the initiator with the cover plate off and partially cut away to reveal the relationship of the internal components.

As shown in FIG. 1, a dual shock tube initiator 10 comprises a housing 11 having a cover plate 12 and an optional and detachable shock tube block 13. The housing has scallops 80 for improved grip. It will be appreciated that the teachings of the present invention may be applied to initiator having only a single firing pin or a device having two firing pins (as illustrated) or to an initiator having three or even more firing pins. Devices of the kind illustrated may be used in commercial, civil and military applications where the initiation of a shock tube is used to trigger the detonation of a remote explosive.

The housing 11 comprises a metallic or plastic block having an internal compartment 14. The internal compartment 14 further comprises a pair of grooves for receiving the reciprocating firing pins 15, 16. The grooves that receive the firing pins 15, 16 lead into guide bores 17, 18 that pass through the front portion or front face 19 of the housing 11. In some embodiments, a shock tube with an integral primer such as the Mk23 style shock tube and primary system is threaded directly into the guide bores 17, 18. In other instances, the optional shock tube block 13 is utilised. The front face 19 of the initiator carries a coupling pin 20 that is received by an opening 21 in the rear portion or rear face of the shock tube block 13. A rotating cam 22 engages a groove 23*a* in the pin 20 and prevents the shock tube 13 from becoming inadvertently dislodged. The shock tube block 13 carries a pair of rear facing primer ports 23. Shock waves generated by the replaceable primers located in the primer ports 23 are carried through internal channels to a gland or glands 24 that act like collets and that are adapted to retain the exposed end of a shock tube. It will be understood that the primer ports 23 fit within the guide bores 17, 18 and are acted upon by the reciprocating firing pins 15, 16 as will be explained.

Figure 2:
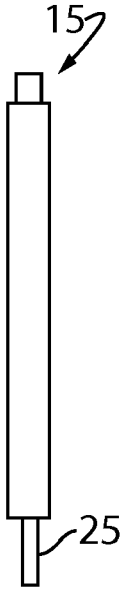
FIG. 2 is a plan view of a firing pin.
Figure 3:
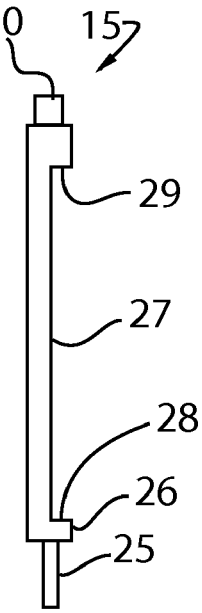
FIG. 3 is a plan view of the firing pin depicted in FIG. 2, rotated by 90°.
Figure 12:
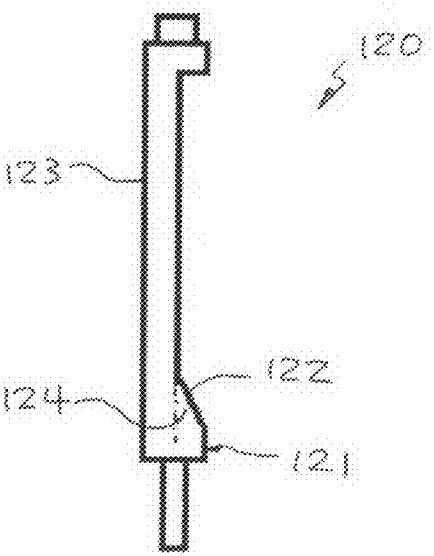
FIG. 12 is a cross section of a further embodiment of the firing pin.

As shown in FIGS. 2 and 3, a firing pin 15 is essentially an elongated pin with a central half-round portion. The forward end of the pin carries a cylindrical nose 25. The nose 25 is carried by a fully cylindrical end section 26 that is located forward of the half-round portion 27. The half-round portion thus defines a forward shoulder 28 and a rear shoulder 29. The rear of the firing pin carries a small stub 30 for locating and retaining the compression springs 31 that drive the firing pins 15, 16 forward. As shown in FIG. 12, the front (or "forward") end 121 of the firing pin 120 may further carry a chamfer 122. This chamfer 122 cooperates with the chamfer carried by the firing plunger, and facilitates the rearward movement of the firing pins past the firing plunger. For example the chamfer 123 may be bevelled so that it is inclined from the central half-round portion 123 by an angle 124 of about 30°.

Figure 4:
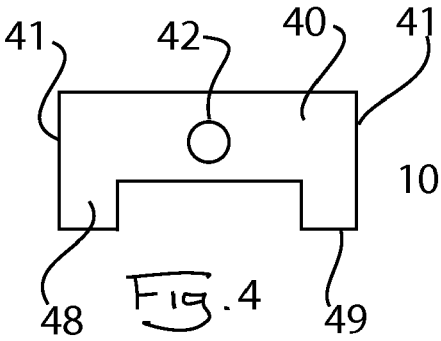
FIG. 4 is a front elevation of a cocking block.
Figure 11:
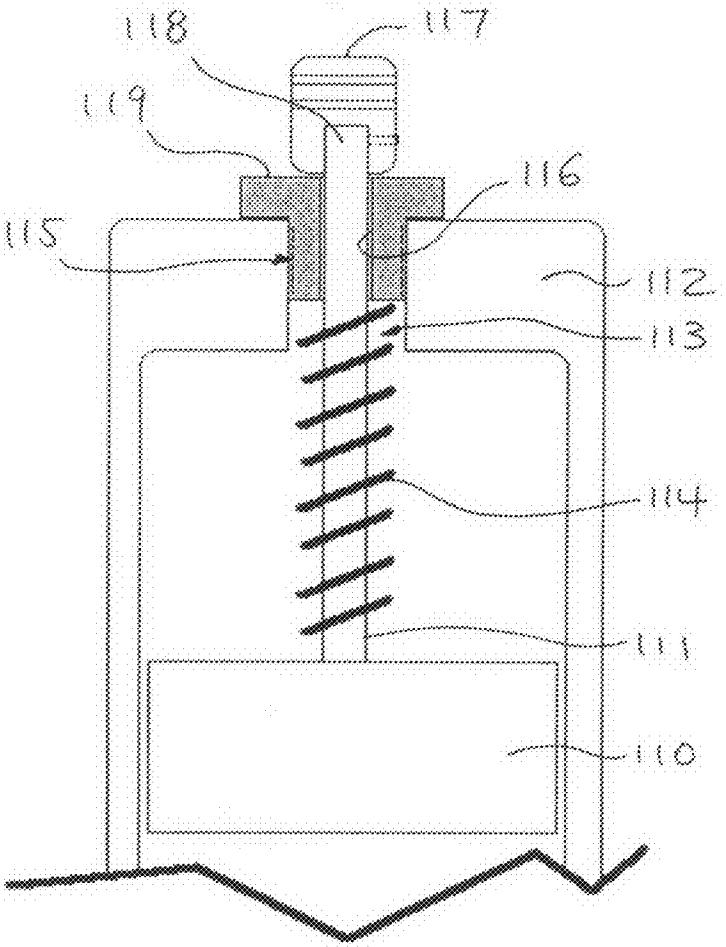
FIG. 11 is a cross section showing another embodiment of the cocking block, cocking handle, and gripping feature.

As shown in FIGS. 1 and 4, a reciprocating cocking block 40 is carried within the housing 11. The lateral ends 41 of the cocking block are guided by the internal longitudinal sides of the internal compartment 14. The cocking block 40 features a central through opening 42 that is adapted to receive the cocking handle 43. The cocking handle 43 is in the form of a shaft that passes through one end of the housing 11 and then through the opening 42 where it is retained by a nut 44. The cocking handle 43 further comprises a cylindrical boss 45 having a threaded exterior that is received by cooperating threads formed in an opening in the end face 46 of the housing 11. The cocking handle 43 cannot be retracted unless the threads 45 are disengaged by rotating the shaft 43, for example by utilising the pull ring 47 carried in an opening at the end of the shaft 43. The pull ring 47 is therefore considered a gripping feature that is utilized by the user to retract the cocking handle 43. Another example of the gripping feature and the corresponding cocking handle arrangement, where the user can retract the cocking handle without disengaging the handle from any thread, is depicted in FIG. 11.

When the threads 45 are disengaged, the shaft 43 can be retracted. This causes the retraction of the cocking block 40. In another embodiment, the shaft 111 can be retracted by directly pulling on the gripping feature 117 (see FIG. 11). As can be appreciated from FIG. 4, the cocking block 40 carries a pair of projections 48, each having a lower surface 49 that runs along the flat face of the half-round portion 27 of the firing pin. As suggested by FIG. 1, the rear surface of the projections 48 make contact with the rear shoulder 29 of each of the firing pins and thus retraction of the cocking block 40 causes the pins 15, 16 to retract against the compression springs 31.

For the above referenced retraction or cocking to occur, the devices rotary safety 70 must be disengaged by the user, as will be explained. For the moment, presuming that the rotary safety 70 has been disengaged or disabled, the end section 26 of the firing pins 15, 16 will slide backward past the rotary safety 70 and past the firing plunger 50.

Figure 5:
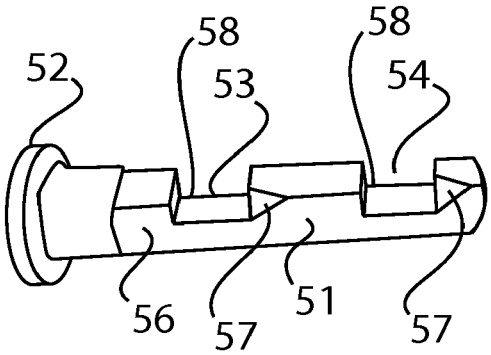
FIG. 5 is a perspective view of the firing plunger.

As shown in FIGS. 1 and 5, the firing plunger 50 comprises a non-rotating, reciprocating shaft 51 having an enlarged head 52 and a pair of slots 53, 54. The firing plunger 50 is urged into a retracted position by a compression spring 55 that is located between the housing 11 and the enlarged head 52. The firing plunger 50 is prevented from rotating, for example, by a pair of spring pins retained by the housing 11. The spring pins bear on flat portions 56 of the firing pin's shaft 51. Note that the lower edges of the forward faces of the slots 53, 54 each carry a chamfer 57. When the firing pins 15, 16 are retracted by the cocking block 40, the front shoulders 28 of each pin engage with the chamfers 57 and cause the firing plunger 50 to move downward against the bias of the spring 55. Once the cylindrical forward portion 26 of each pin has cleared the rear edge 58 of each of the slots 53, 54, the firing plunger 50 returns to its original retracted position under the influence of the compression spring 55. In this position, forward movement of the pins is prevented owing to mechanical interference between the end section of the pins 26 and the rear edges of the slots 53, 54. Presuming again that the rotary safety has been disabled, depressing the firing plunger 50 will cause the plunger to move downward, clearing the way for the pins to pass through the slots 53, 54 under the influence of their compression springs 31. This is the action that ultimately drives the nose 25 of the firing pins 15 into the primer.

The operation of the rotary safety 70 will now be explained. As shown in FIGS. 1 and 6-8, the rotary safety 70 comprises an external knob 71 in which is formed a concave channel 72. The knob 71 carries an integral shaft 73 that is retained within the housing. A first safety mechanism preventing inadvertent detonation comprises a transverse opening 74 located through the shaft 73. The housing 11 and its components have corresponding and aligned openings that permit a safety pin to pass through the housing and the opening 74 in the shaft 73. When this pin is in place, rotation of the safety's knob 71 is not possible.

When the pin is removed from the shaft 74, the safety can be rotated by the knob 71 into its disengaged position. In this disengaged or disabled position, the concave channel 72 allows the enlarged head 52 of the firing plunger to be depressed so as to release the cocked firing pins. As shown in FIG. 1 the top surface 75 of the rotary safety 70 sits just below the enlarged round head 52 of the firing plunger. Unless the rotary safety 70 is in its disengaged position, it interferes with the downward movement of the firing plunger 50. This provides the second mechanical safety feature that prevents inadvertent detonation.

Figures 7, 8:
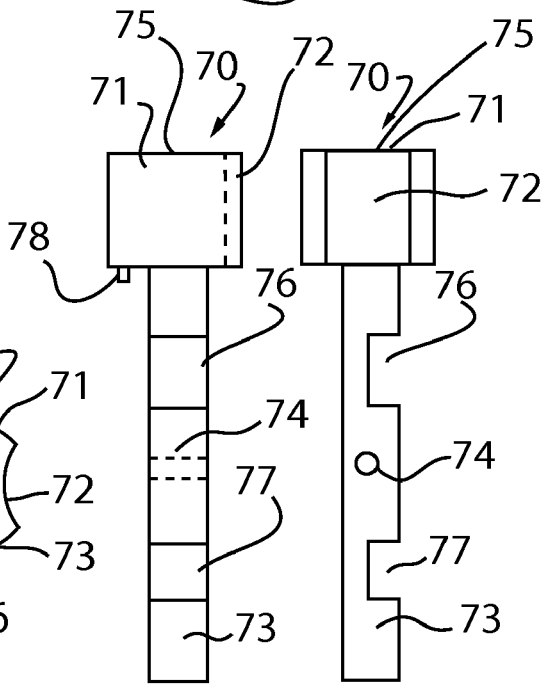
FIG. 7 is a plan view of the rotary safety depicted in FIG. 6.
FIG. 8 is a plan view of the rotary safety depicted in FIG. 7, rotated by 90°.

The third mechanical safety feature is the configuration of the rotary safety's shaft 73. As shown in FIGS. 7 and 8, the shaft 73 features a pair of channels 76, 77. When the rotary safety 70 is defeated and in its disengaged position, the channels 76, 77 face the firing pins 15, 16 and allow the firing pins to reciprocate within the channels. When the rotary safety 70 is other than in its disengaged position, advancement of the firing pins 15, 16 is blocked by the shaft 73. In order to limit the extent of rotation of the rotary safety 70, the underside of the knob 71 may be provided with a small pin 78 that travels within an arc shaped groove located in the surface of the housing 11 just below the knob 71. The groove is an arc of a circle that limits the rotation of the knob 71 to about 90° of rotation. This feature is primarily for the operator's convenience and for speed of operation.

Figure 9:
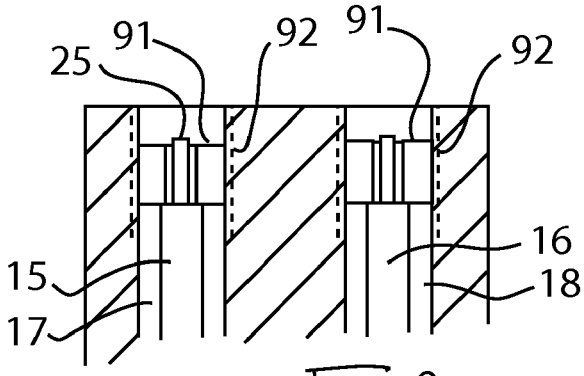
FIG. 9 is a cross section through the front of the initiator main housing illustrating the adjustment of the throw of the firing pins.

As shown in FIG. 9, the forward motion or throw of the firing pins 15, 16 can be limited by using adjustable collars 91 in each of the guide bores 17, 18. The collars 91 have threaded exterior surfaces that engage with cooperating threads 92 formed into the guide bores. Thus, the central opening of the collar 91 allows the nose 25 to protrude, at the same time determining the extent of the nose's advance according to the location of the collar 91 in the guide bore.

Figure 6:
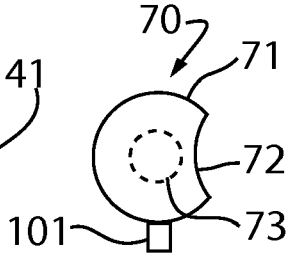
FIG. 6 is a top plan view of a rotary safety.
Figure 10:
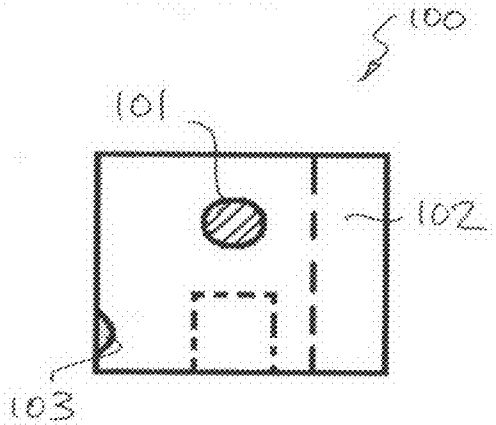
FIG. 10 is a cross section through another embodiment of the knob of the rotary safety.

In some examples, the knob or the rotary safety is provided with extra features for tactile feedback, or for night time operation of the initiator. Referring to FIGS. 1, 6 and 10, the knob 100 includes a tactile feedback stem 101. The user turns the stem 101, and hence the knob 100 to a predetermined location to disengage the rotary safety. The location of the stem 101 away from this predetermined location provides a tactile clue that the rotary safety is engaged. In this example, the stem 101 is provided at a location generally at a right angle to the concave channel 102. To disengage the rotary safety, the user turns the knob 100 so that the stem 101 is at a right angle to the firing plunger.

A night light reflector or a light source, such as a first luminescent or florescent dot 103 on the knob 100 and a second aligning luminescent or florescent dot 93 on the initiator 10, may further be provided as a visual clue as to the state of the rotary safe. For example the user aligns the first and second florescent dots 103, 93 to disengage the rotary safety.

In some embodiments, the gripping feature for the internal cocking block is different to that depicted in FIG. 1. As shown in FIG. 11, the internal cocking block 110 carries a spring biased cocking handle 111. The handle 111 extends to the exterior of the rear portion 112 through a through opening 113 formed into the rear portion 112. This through opening 113 is large enough for a compression spring 114 to be placed through it and onto the handle 111. A nut 115 is in threaded into, and closes, this through opening 113. The nut 115 has a central bore 116. The handle 111 extends rearward through and beyond this central bore 116. A gripping feature 117 is attached to the handle portion 118 that extends rearward of the head 119 of the nut 115. To engage (i.e. retract) the cocking block 110, the user takes hold of the gripping feature 117 and pull the handle 111 rearward through the central bore 116. In this embodiment the cocking lever (i.e. handle) 111 returns automatically upon being released by the user.

The firing sequence is as follows. It will be appreciated that the device can only be cocked when the rotary safety 70, 100 is in the firing position. However, once cocked, the rotary safety can be applied to prevent accidental discharge. The shock tube block 13 is disconnected from the housing. This is done by disengaging the cam lock 22 and withdrawing the primer ports 23 from the guide bores 17, 18. If shock primers are present, they are removed from the ports 23. The main body is grasped being sure not to touch the firing plunger. With the rotary safety 70, 100 in the firing position, the cocking lever is pulled fully to the rear in one motion. In some embodiments the cocking lever is pulled after the cocking lever threads 45 are unscrewed. The user will hear a click as the firing plunger 50 resets to its original retracted position. The enlarged head 52 now sits above the knob of the rotary safety 71, 100. In embodiments where cocking lever threads 45 are included, the cocking lever is then returned into the housing and fixed by turning it approximately three turns counter clockwise. If the operator does not hear the re-set click and the firing plunger does not depress, the user re-cocks the device until the sound of the firing plunger re-setting is heard. The device is made safe by rotating the rotary safety 70 one quarter turn anti-clockwise so that the concave channel 72 points away from the firing pin 50 and toward an "S" printed on the surface of the housing. In some embodiments, the rotary safety 100 is turned so that the tactile feedback stem 101 is not at a right angle to the axis of the plunger. In further embodiments, the device is made safe by turning rotary safety 100 so that the luminescent or florescent dot 103 on the safety 100 does not align with the corresponding dot 93 provided on the housing. Note that if the rotary safety 70, 100 will not turn, then the device has not been cocked correctly and should be re-cocked. With the rotary safety, now interfering with the downward motion of the firing plunger 50, the shock tube block is prepared. The shock tube is cut and placed into the shock tube block via the cable glands 24. The shock tube is inserted into the gland at approximately 50 mm. The cable glands are tightened so that the shock tube is secure. Shock primers are now placed into the shock ports 23. The shock tube block 13 can then be positioned into engagement with the main housing by locating the opening 21 over the pin 20 and inserting the ports 23 into the corresponding guide bores 17, 18. The shock tube may now be firmly affixed to the main housing by rotating the cam lock 22 until the block is pulled up against the main body fully.

As this point, the rotary safety can be turned a quarter turn clockwise (toward the firing plunger) so that the machine's concave portion 72 aligns with the round edge of the head of the firing plunger. In some examples, the rotary safety 100 is turned so that the stem is at a right angle the plunger. The rotary safety may also be turned so that the luminescent dots on the rotary safety and on the housing are aligned. Maintaining the rotary safety in the corresponding "safe" position may be assisted by a detent mechanism extending between the housing and the shaft of the rotary safety. With the head of the plunger now able to clear the rotary safety, the head 52 of the plunger is depressed, making sure that the user's hand is not covering the gas exhaust ports on the shock tube block. In the event of a misfire, the user unscrews the cocking handle 43 and re-cocks the device, or directly pulls the cocking handle 111 reward, and depresses the firing plunger again.

The user is to never fire the initiator of the present invention without a shock tube in the cable gland, as exhaust gases may cause damage to the rubber grommets in the cable gland 24. However, the device may be test fired with an old shock tube or with no detonator. The user is cautioned to always leave the device in the fired position so that the firing pin springs 31 are not under tension.

All working parts are preferably lubricated with dry graphite powder as this reduces the risk of attracting dust and helps prevent fowling. If the device has been submersed in water for long periods of time, the user need only remove the cover plate and wash it with fresh water. The device should then be allowed to dry and then sprayed with graphite powder.

While the present invention has been disclosed with reference to particular details of construction, these should be understood as having been provided by way of example and not as limitations to the scope or spirit of the invention.

What is claimed is:

1. A shock tube initiator, comprising:

a housing having a front portion, a rear, portion, and an internal compartment between the front and rear portion s;

one or more grooves located within the internal compartment, the grooves leading into guide bores that pass through the front portion;

two firing pins adapted to reciprocate in the grooves, each pin having a forward end that carries a front nose and a rearward end that carries a rear stub;

the rear stub being adapted to locate and retain a compression spring for driving the firing pins forward;

a first safety mechanism for preventing an inadvertent retraction of the pins against the compression spring;

a cocking block located to the front of, and is adapted to retract, the firing pins;

the cocking block receiving, and being retractable by, a cocking handle that passes through the block and a rear end of the housing; and a reciprocating firing plunger having a depressed position in which the plunger interferes with the firing pin, or a retracted position in which the plunger does not interfere with the firing pin.

2. The device of claim 1, wherein, each firing pin further comprises a central half-round portion between the forward and rearward ends, each end having a fully-rounded section, the central half-round portion having a forward shoulder and a rearward shoulder.

3. The device of claim 2, wherein, the cocking block further comprises a pair of projections, each projection having a lower surface that contacts the rear shoulder of, and runs along, the half-round portion of one of the firing pins.

4. The device of claim 1, wherein, the rear portion further comprises a through opening, wherein a nut having a central bore is in threaded into the through opening, and the cocking handle extends through the central bore, the cocking handle being biased by a compression spring located between the nut and the cocking block.

5. The device of claim 4, further comprising, a gripping feature for retracting the cocking handle, the gripping feature being located rearward of a head of the nut.

6. The device of claim 1, wherein, the firing plunger further comprises a reciprocating, non-rotating shaft, the shaft having an enlarged head located outside the housing.

7. The device of claim 6, wherein, the housing retains spring pins that bear on a flat portion of the shaft, for preventing a rotation of the shaft.

8. The device of claim 6, wherein, a compression spring is provided between the enlarged head and the housing, wherein the spring urges the firing plunger into a retracted position, and a compression of the spring is adapted to unblock a forward movement of the firing pins.

9. The device of claim 6, wherein, the shaft has formed in it a pair of slots, wherein an edge of a forward portion of each slot carries a chamfer, the chamfer being adapted to engage with one of the firing pins.

10. The device of claim 9, wherein, the firing pin is adapted to clear a rear edge of the corresponding slot while being retracted by the cocking block.

11. The device of claim 10, wherein, the firing plunger is adapted to move against the compression spring between the enlarged head and the housing while the firing pin is retracted past the chamfer of the corresponding slot, and to return to an original retracted position after the firing pin clears the rear edge of the slot.

12. The device of claim 1, further comprising, a rotary safety further comprising an external knob having a top surface, wherein a channel is formed along the knob, the top surface being adapted to interfere with a downward movement of the firing plunger in an engaged position, and clear the downward movement in a disengaged position.

13. The device of claim 12, wherein, the rotary safety further carries a shaft that is retained within the housing, wherein the first safety mechanism comprises a transverse opening formed into the shaft, an aligned opening formed into the housing, and a pin passing through both openings.

14. The device of claim 13, further comprising, another safety mechanism, the other mechanism further comprising a pair of channels formed into the rotary safety's shaft, wherein the firing pins are adapted to reciprocate within the channels when the rotary safety is in a disengaged position.

15. The device of claim 12, wherein, a small pin located on an underside of the external knob is adapted to travel along an arc-shaped groove located in a housing surface, wherein the groove limits a rotation of the knob.

16. The device of claim 1, further comprising, an adjustable collar located within each guide bore, the collar being adapted to limit a throw of the firing pin.

17. The device of claim 1, further comprising, a detachable shock tube block further comprising a pair of rear facing primer ports that hold replaceable primers, and are adapted to fit into the guide bores, the shock tube block having formed in it a rear opening adapted to receive a coupling pin carried by the front portion of the shock tube initiator.

18. The device of claim 17, wherein, the shock tube block further comprises a front facing gland for retaining an exposed end of a shock tube, and an internal channel for carrying a shock wave from the primer port to the shock tube.

19. The device of claim 17, wherein, the shock tube block further comprises an internal rotating cam, the rotating cam being adapted to engage a groove in the coupling pin, for preventing an inadvertent dislodgement of the shock tube block from the shock tube initiator.

20. The device of claim 9, wherein the housing further comprises scallops to facilitate gripping.

* * * * *